US011181331B2

(12) United States Patent
Schafer

(10) Patent No.: US 11,181,331 B2
(45) Date of Patent: Nov. 23, 2021

(54) BOLT ASSEMBLY FOR FIREARMS AND METHODS OF MANUFACTURE AND CLEARING A CARTRIDGE THEREOF

(71) Applicant: Q, LLC, Portsmouth, NH (US)

(72) Inventor: Nicholas Schafer, Portsmouth, NH (US)

(73) Assignee: Q, LLC, Portsmouth, NH (US)

( * ) Notice: Subject to any disclaimer, the term of this patent is extended or adjusted under 35 U.S.C. 154(b) by 0 days.

(21) Appl. No.: 16/704,517

(22) Filed: Dec. 5, 2019

(65) Prior Publication Data

US 2020/0109903 A1 Apr. 9, 2020

Related U.S. Application Data

(62) Division of application No. 15/471,052, filed on Mar. 28, 2017, now Pat. No. 10,533,816.

(60) Provisional application No. 62/444,867, filed on Jan. 11, 2017.

(51) Int. Cl.

| | |
|---|---|
| ***F41A 3/22*** | (2006.01) |
| ***F41A 15/12*** | (2006.01) |
| ***F41A 3/72*** | (2006.01) |

(52) U.S. Cl.
CPC ..... *F41A 3/22* (2013.01); *F41A 3/72* (2013.01); *F41A 15/12* (2013.01)

(58) Field of Classification Search
CPC ..... F41A 3/22; F41A 3/24; F41A 3/12; F41A 3/18; F41A 3/66; F41A 15/12
See application file for complete search history.

(56) References Cited

U.S. PATENT DOCUMENTS

| | | | | |
|---|---|---|---|---|
| 5,926,988 | A * | 7/1999 | Casull | F41A 3/72 42/25 |
| 2009/0000175 | A1 | 1/2009 | Potterfield et al. | |
| 2009/0126250 | A1 | 5/2009 | Keng | |
| 2015/0362278 | A1 | 12/2015 | Genchel et al. | |
| 2016/0265864 | A1 | 9/2016 | Poling | |
| 2017/0167817 | A1 | 6/2017 | Hayes | |

* cited by examiner

*Primary Examiner* — J. Woodrow Eldred
(74) *Attorney, Agent, or Firm* — Fox Rothschild LLP

(57) ABSTRACT

A rifle includes a receiver and a bolt body at least partially disposed in the receiver and including a body axis. The bolt body is discretely (1) rotatable about the body axis within the receiver and (2) axially slidable along the body axis. The rife also includes a bolt handle coupled to the bolt body so as to discretely (1) rotate with the bolt body about the body axis and (2) move with the bolt body along the body axis.

20 Claims, 15 Drawing Sheets

BOLT ASSEMBLY FOR FIREARMS AND METHODS OF MANUFACTURE AND CLEARING A CARTRIDGE THEREOF

CROSS-REFERENCE TO RELATED APPLICATIONS

This application is a divisional of U.S. patent application Ser. No. 15/471,052 filed Mar. 28, 2017, which claims the benefit of priority to U.S. Provisional Patent Application No. 62/444,867 filed Jan. 11, 2017, the disclosures of all of which are hereby incorporated by reference in their entireties.

INTRODUCTION

Bolt action rifles are firearms where the user manually cycles the bolt in order to chamber a round of ammunition. Bolt action rifles are commonly used for long range shooting (e.g., hunting, target shooting, etc.). Due to their general simplicity, bolt action rifles are considered to be reliable, accurate, and practical in scenarios where a rapid rate of firing is unneeded.

Some known bolt action rifles include a receiver with a slidable and rotatable bolt disposed therein. The bolt typically has lugs extending therefrom that engage with a firing chamber to lock the bolt in place during firing. Additionally, the bolt includes a handle that may be used to rotate the bolt. After a projectile is fired, the bolt is manually rotated via the handle in relation to the firing chamber to disengage the lugs and facilitate ejecting a projectile cartridge. The handle and the lugs may include corresponding cammed surfaces to facilitate disengaging the lugs from the receiver during the rotating motion of the bolt. As the handle rotates, the handle cam engages with the receiver cam to make the initial extraction pull of the bolt and to begin rearward movement of the bolt. The rotation of the handle also engages the lug cam with the firing chamber such that the lugs are disengaged for the initial extraction pull. This movement of the bolt is often referred to as bolt timing.

However, the handle may axially move with respect to the receiver such that the cammed surfaces become unaligned and bolt timing is decreased. When this occurs, rotation of the bolt may not engage the cammed surfaces and thus not begin the initial extraction pull. Additionally, by including the cammed surfaces on the lugs, the strength of the lugs is decreased. As such, the projectiles that are used in the bolt action rifle may be unnecessarily limited in size and power due to the amount of thrust they induce within the firing chamber.

SUMMARY

The present disclosure relates generally to a bolt assembly for a firearm.

In one aspect a rifle is provided. The rife includes a receiver; a bolt body at least partially disposed in the receiver and including a body axis, wherein the bolt body is discretely (1) rotatable about the body axis within the receiver and (2) axially slidable along the body axis; and a bolt handle coupled to the bolt body so as to discretely (1) rotate with the bolt body about the body axis and (2) move with the bolt body along the body axis.

In an example, the rife further includes a cam coupling the bolt handle to the bolt body. In another example, the rife further includes a fulcrum fixed relative to the receiver, wherein the cam is configured to engage the fulcrum prior to the bolt body axially sliding along the body axis. In yet another example, the engagement between the cam and the fulcrum pivots the bolt handle about an axis substantially skew to the body axis. In still another example, the engagement between the cam and the fulcrum slides the bolt body along the body axis. In another example, the rife further includes a shroud slidably engaged with the receiver, wherein axial sliding of the bolt body moves the shroud relative to the receiver. In yet another example, the bolt handle is configured to pivot in a range of 0 degrees to 90 degrees.

In another aspect, a method of manufacturing a firearm including a receiver and a bolt assembly is provided. The method includes forming a bolt including a body axis; coupling a bolt body to the bolt, wherein the bolt body is configured to discretely (1) rotate about the body axis within the receiver and (2) axially slide along the body axis; coupling a bolt handle to the bolt body; and inserting the bolt body into the receiver such that the bolt handle is configured to discretely (1) rotate with the bolt body about the body axis and (2) move with the bolt body along the body axis.

In an example, the method further includes forming the bolt with a plurality of bolt lugs extending radially therefrom; and forming a firing chamber in the firearm, wherein the firing chamber comprising a plurality of firing chamber lugs extending radially therefrom, wherein the plurality of bolt lugs are configured to rotatably engage with the plurality of firing chamber lugs. In another example, the method further includes forming a shroud, wherein the shroud is configured to slidably engage with the receiver and wherein axial sliding of the bolt body within the receiver moves the shroud relative to the receiver. In yet another example, the method further includes forming the bolt handle with a cam, wherein the cam is configured to couple the bolt handle to the bolt body. In still another example, the method further includes forming the bolt around a firing pin.

In a further aspect, an apparatus is provided. The apparatus includes a firing chamber defining an axis and including a plurality of firing chamber lugs; a bolt axially aligned with the firing chamber and including a plurality of bolt lugs, wherein the plurality of bolt lugs are disposed radially asymmetrically about the axis, and wherein the plurality of bolt lugs are each rotatably engageable with one of the plurality of firing chamber lugs; a bolt body engaged with the bolt, wherein rotation of the bolt body rotates the bolt; and a bolt handle engaged with the bolt body.

In an example, the bolt handle is pivotably engaged with the bolt body. In another example, when the bolt handle is in a first rotated position, the plurality of bolt lugs are engaged with the plurality of firing chamber lugs. In yet another example, when the bolt handle is in a second rotated position, the plurality of bolt lugs are disengaged and offset from the plurality of firing chamber lugs. In still another example, when the bolt handle is in a first pivoted position, the plurality of bolt lugs are axially disposed a predetermined distance from the plurality of firing chamber lugs. In another example, the apparatus further includes a cam for pivotably engaging the bolt handle with the bolt body. In yet another example, the apparatus further includes a firing pin extending axially from the bolt. In still another example, the cam comprises a plurality of tines extending therefrom, wherein the tines are disposed on opposite sides of a firing pin shaft.

In yet another aspect, a method of clearing a cartridge from a firearm including a bolt body rotatably and slidably disposed in a receiver is provided. The method includes rotating, about a body axis defined by the bolt body, a bolt handle from a first rotated position to a second rotated position, so as to rotate the bolt body about the body axis; after disposing the bolt handle in the second rotated position, pivoting the bolt handle about a pivot axis disposed at an angle to the body axis; substantially simultaneously with pivoting the bolt handle, sliding the bolt body from a forward position within the receiver towards a rearward position within the receiver; and sliding the bolt body into the rearward position, so as to eject the cartridge from the receiver.

In an example, the pivoting operation causes a cam disposed on the bolt handle to contact a fulcrum disposed on a shroud so as to slide the bolt body towards the rearward position.

A variety of additional aspects will be set forth in the description that follows. The aspects can relate to individual features and to combination of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings.

DETAILED DESCRIPTION

Figure 1:
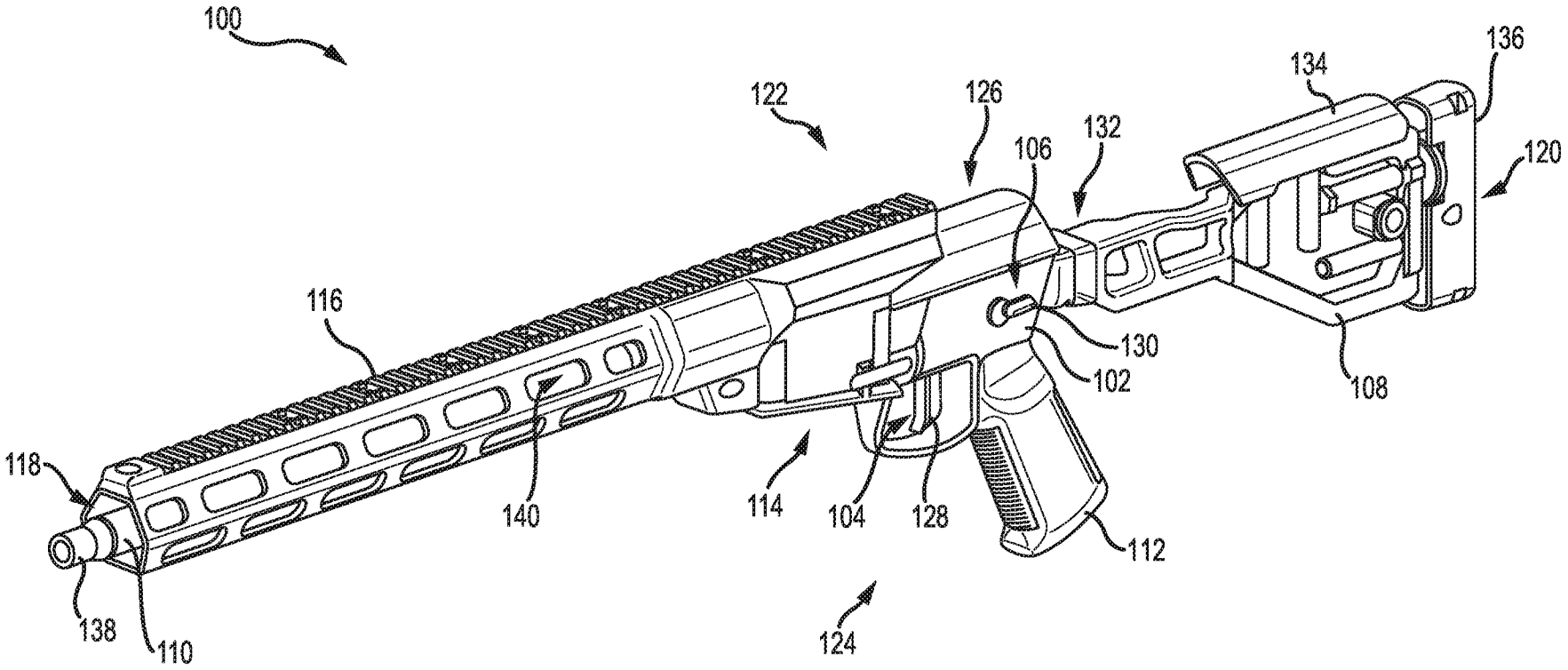
FIG. 1 is a perspective view of an example firearm.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a perspective view of an example firearm 100. In the example, the firearm 100 includes a receiver 102 that may house a trigger mechanism 104 and a safety mechanism 106. The firearm 100 may also include a stock 108, a barrel 110, a grip 112, a magazine well 114 defined in the receiver 102, and a rail 116. Generally, the firearm 100 includes a front 118 in the direction of the barrel 110, a back 120 in the direction of the stock 108, a top 122 in the direction of the rail 116, and a bottom 124 in the direction of the grip 112. Throughout this disclosure, references to orientation (e.g., front(ward), rear(ward), in front, behind, above, below, high, low, back, top, bottom, under, underside, etc.) of structural components shall be defined by the position of that component relative to the front 118, back 120, top 122, and/or bottom 124 of the firearm 100, regardless of how the firearm 100 may be held and regardless of how that component may be situated on its own (e.g., separated from the firearm 100).

In the example, the firearm 100 is a bolt action rifle. In alternative examples, the firearm 100 is any other bolt action firearm. The firearm 100 includes a bolt assembly or apparatus 126 that is slidably disposed in the receiver 102 and will be described in further detail below. The bolt assembly 126 may be removable from the receiver 102 via a bolt release assembly 208 (shown in FIG. 3A). The bolt assembly 126 interfaces with the trigger mechanism 104 and safety mechanism 106 to facilitate discharging the firearm 100. The trigger mechanism 104 includes a trigger bow 128 pivotally mounted in the receiver 102 that is configured to be pulled by a finger of a user (e.g., the index finger) to discharge the firearm 100. The trigger mechanism 104 induces a discharge (e.g., firing) of the firearm 100 when a predetermined amount of force is applied to the trigger bow 128. The safety mechanism 106 includes a safety mechanism lever 130 disposed in a side of the receiver 102 and is in communication with the trigger mechanism 104. The safety mechanism lever 130 is switchable between multiple positions, such as a fire mode position and a safe mode position, to facilitate switching the firearm 100 between different operating modes.

The stock 108 is coupled to the receiver 102 and positioned at the back 120 of the firearm 100 to provide an additional surface for the user to support the firearm 100, for example, against the user's shoulder. The stock 108 may be foldable about a hinge 132 and include an adjustable cheek pad 134 and an adjustable recoil pad 136. As illustrated in FIG. 1, the stock 108 has a skeleton frame construction to reduce weight of the firearm 100. The barrel 110 is also coupled to the receiver 102 and positioned at the front 118 of the firearm 100 to provide a path to release an explosion gas and propel a projectile therethrough. The barrel 110 may be readily removable from the receiver 102, such that the user can individually couple multiple barrels to the receiver 102, each barrel configured for a different caliber of projectile. A front 138 of the barrel 110 may protrude from the rail 116 and be threaded to facilitate attachment of firearm accessories.

The rail 116 may be mounted around the barrel 110, for example, with a barrel nut (not shown), such that the rail 116 abuts the receiver 102. The rail 116 (also known as a handguard) surrounds at least a portion of the barrel 110 and can function as a support for the user's front hand with firing the firearm 100 and/or act to prevent the user's hand from getting burned by the barrel 110 during operation. One or more apertures 140 may be defined within the rail to reduce weight of the firearm 100, and also serve at heat vents, thereby reducing excessive heat build-up between the rail 116 and the barrel 110. The rail 116 may include a top surface 142 and a bottom surface 144 for mounting firearm accessories (e.g., a bi-pod, a laser, optic equipment, etc.) thereto. Each surface 142 and 144 may include a plurality of mounting ribs 146 that provide a platform for mounting firearm accessories on the rail 116. For example, the mounting ribs 146 are of a standard dimension, such as a "Picatinny" style mount platform, also known as MIL-STD-1913. The top surface 142 may extend along substantially the entire length of the rail 116 and the bottom surface 144 may extend along the front of the rail 116.

The grip 112 may be mounted to the receiver 102 and extend towards the bottom 124 of the firearm 100. The grip 112 provides a point of support of the user of the firearm 100 and may be held by the user's hand, including when operating the trigger mechanism 104, to facilitate stabilizing the firearm 100 during firing and manipulation thereof. The magazine well 114 is configured to receive a magazine (not shown) for projectile storage such that the projectiles therein (not shown) may be channeled to the bolt assembly 126. In alternative examples, the firearm 100 may have any other configuration, for example, omit some of the components described above or add additional components to those described above.

In operation, the firearm 100 is configured to have a safe operating mode and a fire operating mode, controlled by the safety mechanism 106. In the safe operating mode, the firearm 100 may not discharge a projectile therefrom. In the fire operating mode, the bolt assembly 126 is manually movable by the user, via a bolt handle 148 (shown in FIG. 2), to feed a single round of ammunition (e.g., projectile) (not shown) into the receiver 102 for firing. Once the trigger mechanism 104 is pulled and the round of ammunition is discharged, the bolt assembly 126 is manually cycled. For example, the bolt assembly 126 is retracted (slidably moved towards the rear 120) so as to eject the spent round of ammunition from the receiver 102. The bolt assembly 126 may then be manually moved towards the front 118 to feed another round of ammunition into the receiver 102 from the magazine. This process may be repeated again at will for discharging the firearm 100.

Figure 2:
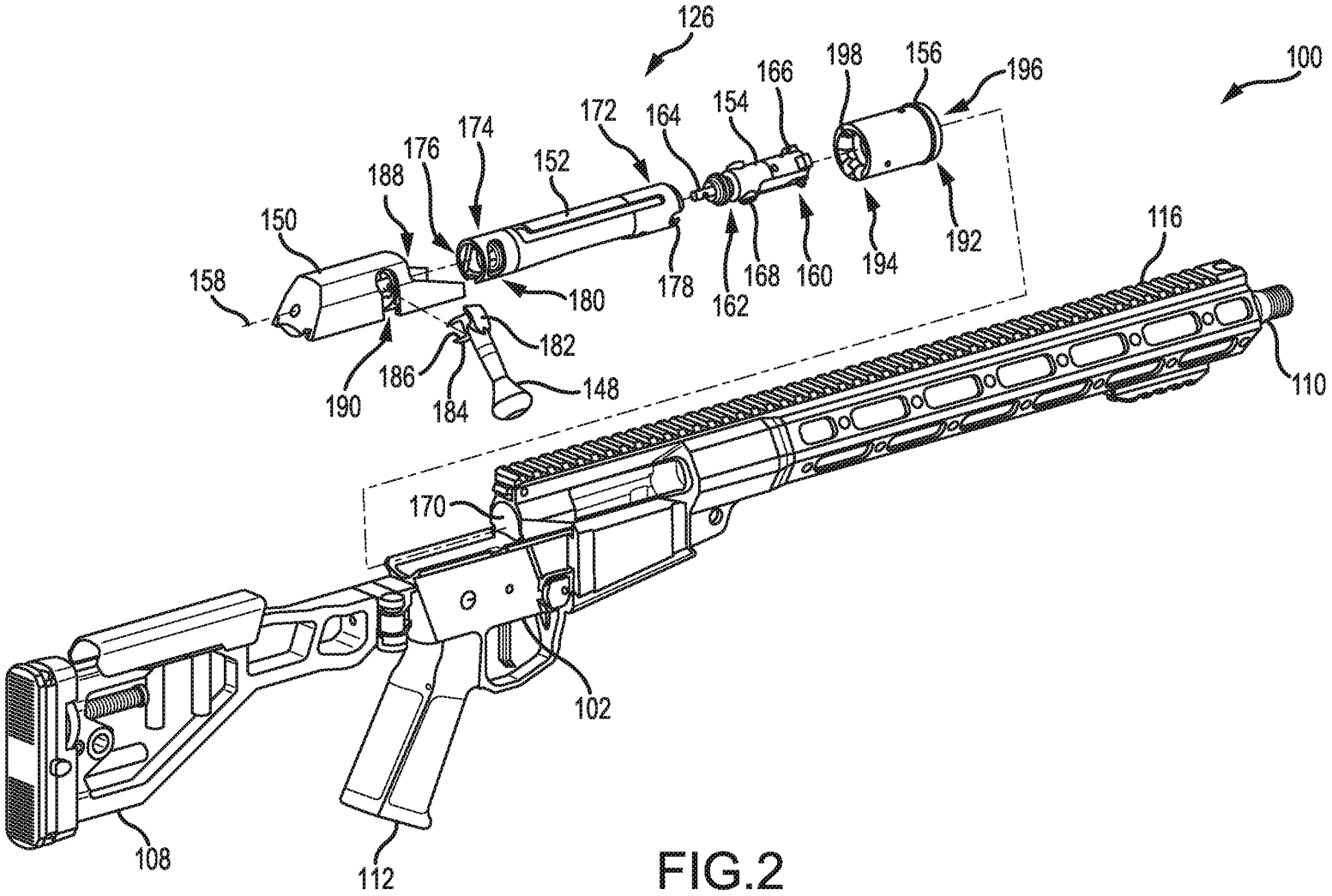
FIG. 2 is an exploded perspective view of the example of FIG. 1.

FIG. 2 is an exploded perspective view of the firearm 100, depicting more clearly the example bolt assembly 126. The bolt assembly 126 includes the handle 148, a shroud 150 slidably engaged with a top portion of the receiver 102, a bolt body 152 at least partially disposed in the receiver 102 and the shroud 150, and a bolt 154 coupled to the bolt body 152. A firing chamber 156 that is defined in the receiver 102 and is coupled in flow communication with the barrel 110 is also illustrated as exploded in FIG. 2. The bolt assembly 126 defines a longitudinal axis 158 in which the shroud 150, the bolt body 152, and the bolt 154 are aligned with the firing chamber 156 from the back 120 to the front 118 of the firearm 100. As used herein, the terms "axial" and "axially" refer to directions and orientations extending substantially parallel to the longitudinal axis 158. Moreover, the terms "radial" and "radially" refer to directions and orientations extending substantially perpendicular to the longitudinal axis 158. In addition, as used herein, the terms "circumferential" and "circumferentially" refer to directions and orientations extending arcuately about the longitudinal axis 158.

The bolt 154 is substantially cylindrically-shaped and extends axially along a body axis that corresponds to the longitudinal axis 158. The bolt 154 includes a forward end 160 and an opposite back end 162, and the bolt 154 at least partially circumferentially surrounds a firing pin 164 configured to induce the discharge of the projectile. At least a portion of the firing pin 164 extends axially away from the bolt 154. The forward end 160 includes a row of a plurality of lugs 166 extending radially outward therefrom, and the back end 162 includes at least one connection element 168. The bolt 154 is positioned axially between the bolt body 152 and the firing chamber 156 and is at least partially disposed within a top opening 170 defined in the receiver 102. The bolt 154 is also rotatable within the receiver 102.

The bolt body 152 is also substantially cylindrically-shaped and extends axially along a body axis that corresponds to the longitudinal axis 158. The bolt body 152 includes a forward end 172 and an opposite back end 174, and defines an opening 176 extending therethrough. The forward end 172 includes at least one corresponding connection element 178 that is configured to couple to connection element 168 such that the bolt body forward end 172 is coupled to the bolt back end 162 and a portion of the firing pin 164 is received within the opening 176. The back end 174 includes a handle opening 180 that is configured to receive a portion of the handle 148. A shaft 202 may extend through the opening 176 as described further below in reference to FIGS. 3A-D. The bolt body 152 is positioned axially between the handle 148 and the bolt 154 and at least partially disposed in the receiver top opening 170. The bolt body is rotatable about the longitudinal axis 158 within the receiver 102 and axially slidable along the longitudinal axis 158 within the receiver 102. This rotational movement and slidable movement are performed discretely during cycling of the bolt action firearm 100.

The handle 148 includes a cam 182 with a radial extension 184 extending therefrom that is configured to be insertable within the handle opening 180 of the bolt body 152. The radial extension 184 is configured to pivotably couple and engage the handle 148 to the bolt body 152 and includes a plurality of tines 186 extending from the cam 182. For example, the tines 186 may be disposed on opposite sides of the shaft 202 when the handle 148 is pivotable coupled to the bolt body back end 174. The radial extension 184 extends radially from the shaft 202 when coupled thereto. The handle 148 is coupled to the bolt body 152 so as to discretely rotate with the bolt body 152 about the longitudinal axis 158 and to move axially with the bolt body 152.

The shroud 150 is slidably coupled to a top portion of the receiver 102 such that the shroud 150 moves axially along the longitudinal axis 158. For example, the shroud 150 runs on corresponding rails formed on the receiver 102. The shroud 150 is axially behind the bolt body 152 and receives at least a portion of the handle 148 and the bolt body 152. The bolt body back end 174 is received within an axial opening 188 defined in the shroud 150 such that the bolt body 152 is rotatable therein. The handle radial extension 184 is received within a circumferential opening 190 defined in a sidewall of the shroud 150 such that the handle is rotatable and pivotable therein. The shroud 150 is configured to axially slide in relation to the receiver 102 when the handle 148 and bolt body 152 are axially moved.

The firing chamber 156 is coupled to the receiver 102 and is fixed in relation thereto. Additionally, the firing chamber 156 is coupled in flow communication with the barrel 110 to facilitate discharging a projectile therefrom. The firing chamber 156 is substantially cylindrically-shaped and extends axially along a body axis that corresponds to the longitudinal axis 158. The firing chamber 156 includes a front end 192 and an opposite back end 194, and defines an opening 196 extending therethrough. The front end 192 includes a plurality of lugs 198 extending radially inward therefrom. The firing chamber lugs 198 correspond to the bolt lugs 166 such that the bolt 154 is rotatably engageable with the firing chamber 156. In the example, both lugs 166 and 198 are spaced circumferentially asymmetrically about the longitudinal axis 158. In alternative embodiments, the lugs 166 and 198 have any other spacing (e.g., symmetrical spacing) that enables the bolt assembly 126 to function as described herein.

In operation, the example bolt assembly 126 is cycleable between four positions to facilitate discharging a projectile from the firearm 100, ejecting the spent casing from the receiver 102, and feeding another projectile into the receiver 102 for a subsequent discharge. For example, the bolt assembly 126 is movable between a firing position, a rotate position, a pivot positon, and an eject position as will be described further below in reference to FIGS. 3A-D.

Figure 3A:
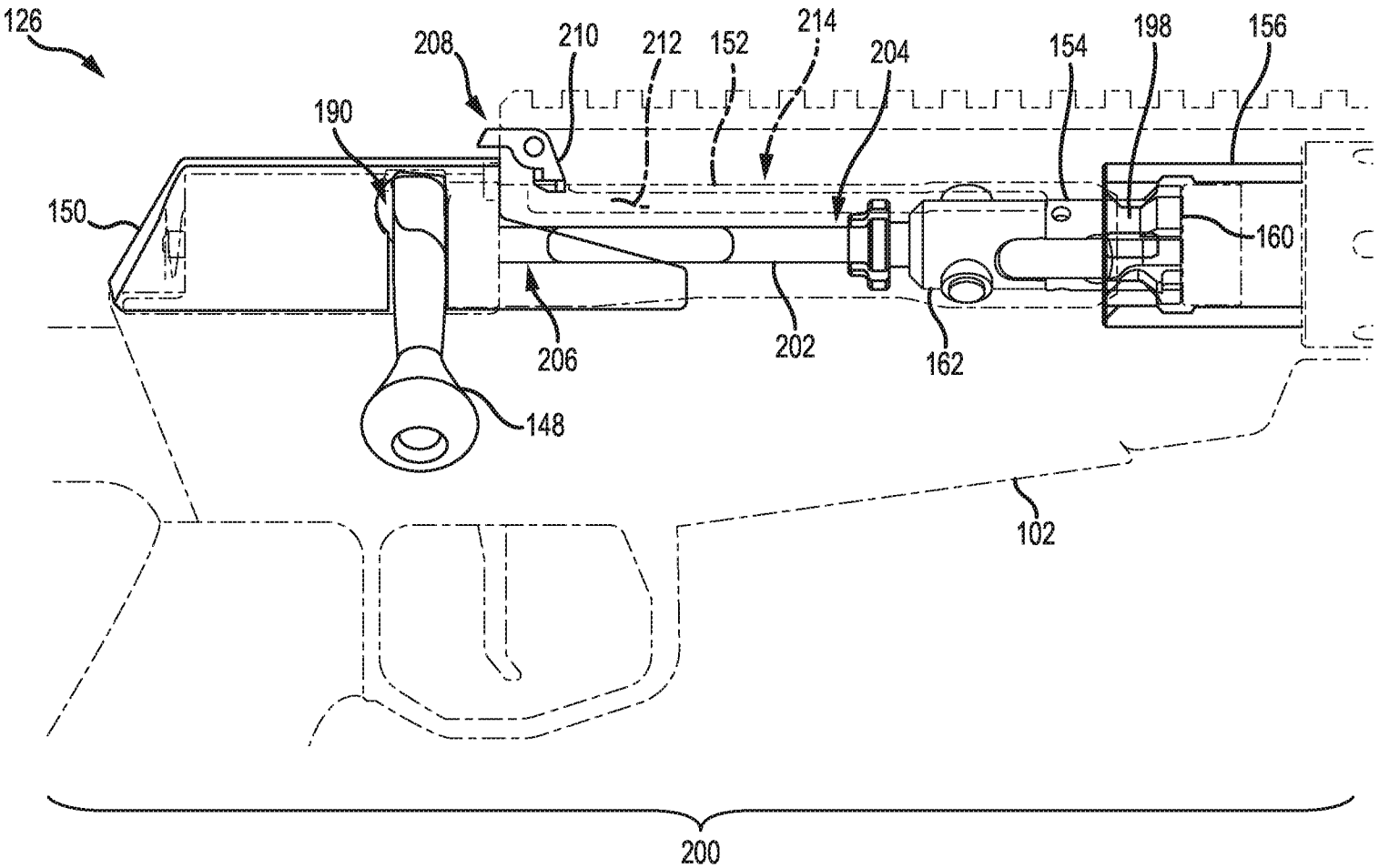
FIG. 3A is a side view of an example bolt assembly in a firing position.

FIG. 3A is a side view of the bolt assembly 126 in a firing position 200. In the firing position 200, the bolt assembly 126 is positioned in an axially forward position. That is, the bolt 154, the bolt body 152, the shroud 150, and the handle 148 are positioned axially forward within the receiver 102. Additionally, the bolt 154, the bolt body 152, and the handle 148 are rotated in a first rotated position within the receiver 102 (shown in FIG. 6A) such that the bolt 154 is engaged with the firing chamber 156 via lugs 166 and 198. The first rotated position is defined by the handle 148 extending substantially downward and adjacent the receiver 102 within the circumferential opening 190, and the bolt 154 engaged with the firing chamber 156. In the example, the bolt body 152 includes a shaft 202 extending through the opening 176. The shaft 202 includes a forward end 204 that is coupled to the bolt back end 162 and the firing pin 164, and a back end 206 that is coupled to the handle radial extension 184, as described further above in reference to FIG. 2, such that rotation of the handle 148 may induce rotation of the bolt 154. Additionally, the bolt body 152 is also at least partially supported within the receiver 102 via a bolt release assembly 208. The bolt release assembly 208 includes a radial extension member 210 that slidably engages with a corresponding groove 212 defined in an outer circumferential surface 214 of the bolt body 152. For example, the groove 212 is substantially "L"-shaped with an axial section and a circumferential section proximate the back end 174 to facilitate both axial movement and rotational movement of the bolt body 152 within the receiver 102. As noted above, these movements are performed discretely from each other.

As described above, a single round of ammunition may be fed into the firing chamber 156 for firing, when the firearm 100 is in the fire operating mode. In the firing position 200, the bolt 154 is engaged with the firing chamber 156 such that the bolt lugs 166 are axially forward of the chamber lugs 198 and the lugs 166 and 198 are axially aligned such that the bolt 154, the bolt body 152, the handle 148, and the shroud 150 are restricted from axial movement backwards. Additionally, the bolt release assembly 208 is slidably engaged with the circumferential section of the bolt body groove 212. The firing position 200 enables the trigger mechanism 104 to be pulled such that the ammunition round is discharged from the firing chamber 156 and thrust loads generated therein from the discharged round are resisted by the bolt assembly 126 through engagement of the lugs 166 and 198. Once the ammunition is fired from the firearm 100, the spent ammunition cartridge remains within the firing chamber 156. To remove and eject the spent cartridge from the receiver 102, the bolt assembly 126 is first moved from the firing position 200 to a rotate position 216 (shown in FIG. 3B).

Figure 3B:
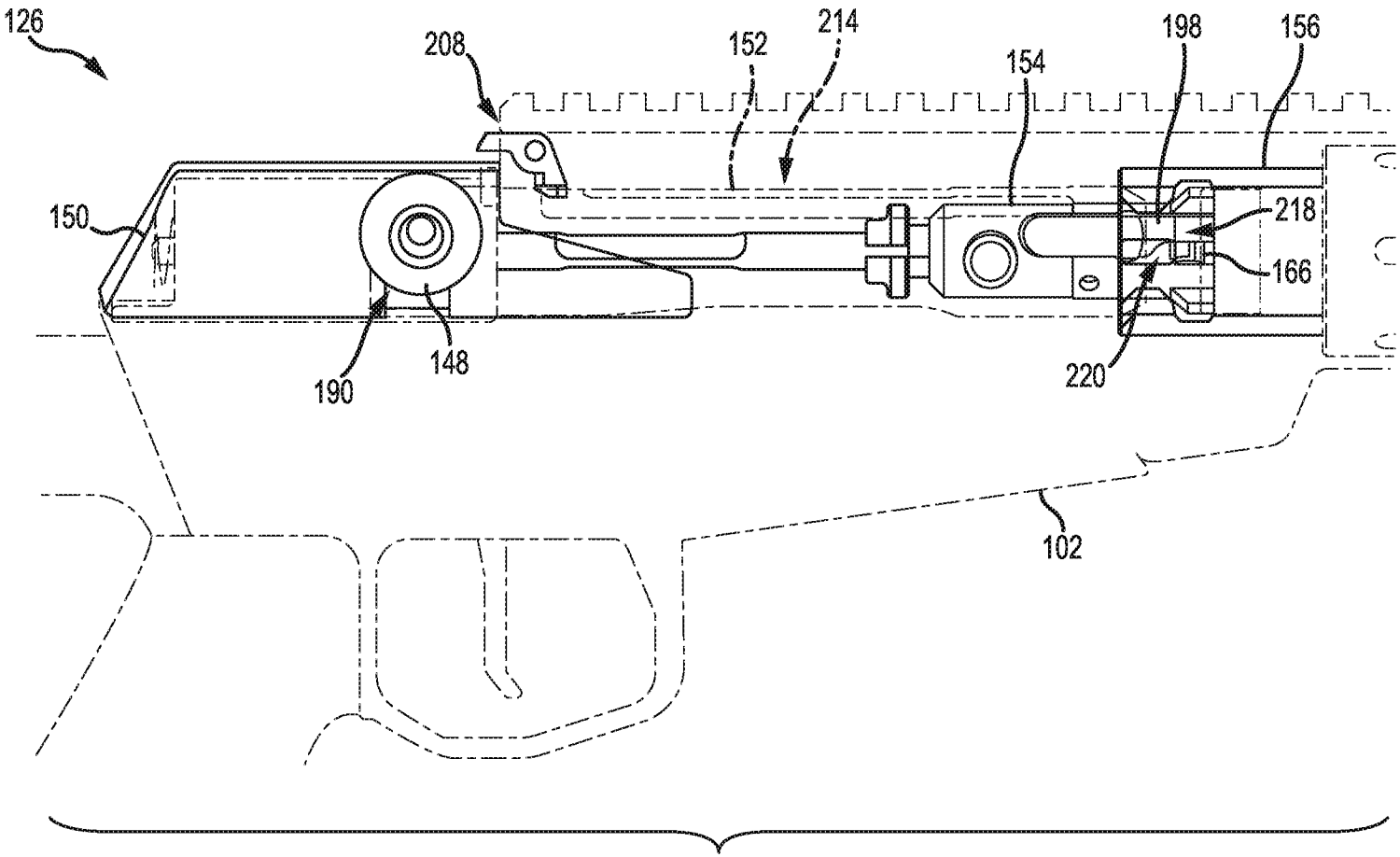
FIG. 3B is a side view of the bolt assembly in a rotate position.

FIG. 3B is a side view of the bolt assembly 126 in the rotate position 216. In the rotate position 216, the bolt assembly 126 is still positioned in the axially forward position such that the bolt lugs 166 are axially forward of the chamber lugs 198 as described above. Additionally, in the rotate position 216, the handle 148 has been rotated about the longitudinal axis 158 and within the shroud circumferential opening 190 in an upwards and counter-clockwise direction from the first rotated position to a second rotated position towards the top 122 of the firearm 100. The second rotated position is defined by the handle 148 extending substantially orthogonal to the receiver 102 (shown in FIG. 6B). As the handle 148 is rotated from the first rotated position to the second rotated position, the cam 182 slidably engages with a circumferential groove 232 defined on an inner circumferential surface 230 of the shroud 150 (shown in FIGS. 4A-C). Additionally, the radial extension 184 simultaneously rotates the bolt body 152 and the bolt 154 within the receiver 102 and the shroud 150 about the longitudinal axis 158 such that the bolt lugs 166 are axially offset and unaligned with the chamber lugs 198.

For example, a plurality of circumferentially spaced recesses 218 are defined between each bolt lug 166 on the bolt 154 and a plurality of circumferentially spaced recesses 220 are defined between each chamber lug 198 on the firing chamber 156. When the handle 148 is rotated from the first rotated position to the second rotated position, the bolt lugs 166 are axially aligned with the corresponding chamber recesses 220 and the chamber lugs 198 are axially aligned with the corresponding bolt recesses 218. Additionally, the bolt body 152 rotates in relation to the bolt release assembly 208 such that the bolt release assembly 208 slides along the circumferential section of the groove 212.

In the rotate position 216, the spent ammunition cartridge remains within the firing chamber 156. However, the bolt 154 has begun to disengage with the firing chamber 156. To continue removal and ejection of the spent cartridge from the receiver 102, the bolt assembly 126 is next moved from the rotate position 216 to a pivot position 222 (shown in FIG. 3C).

Figure 3C:
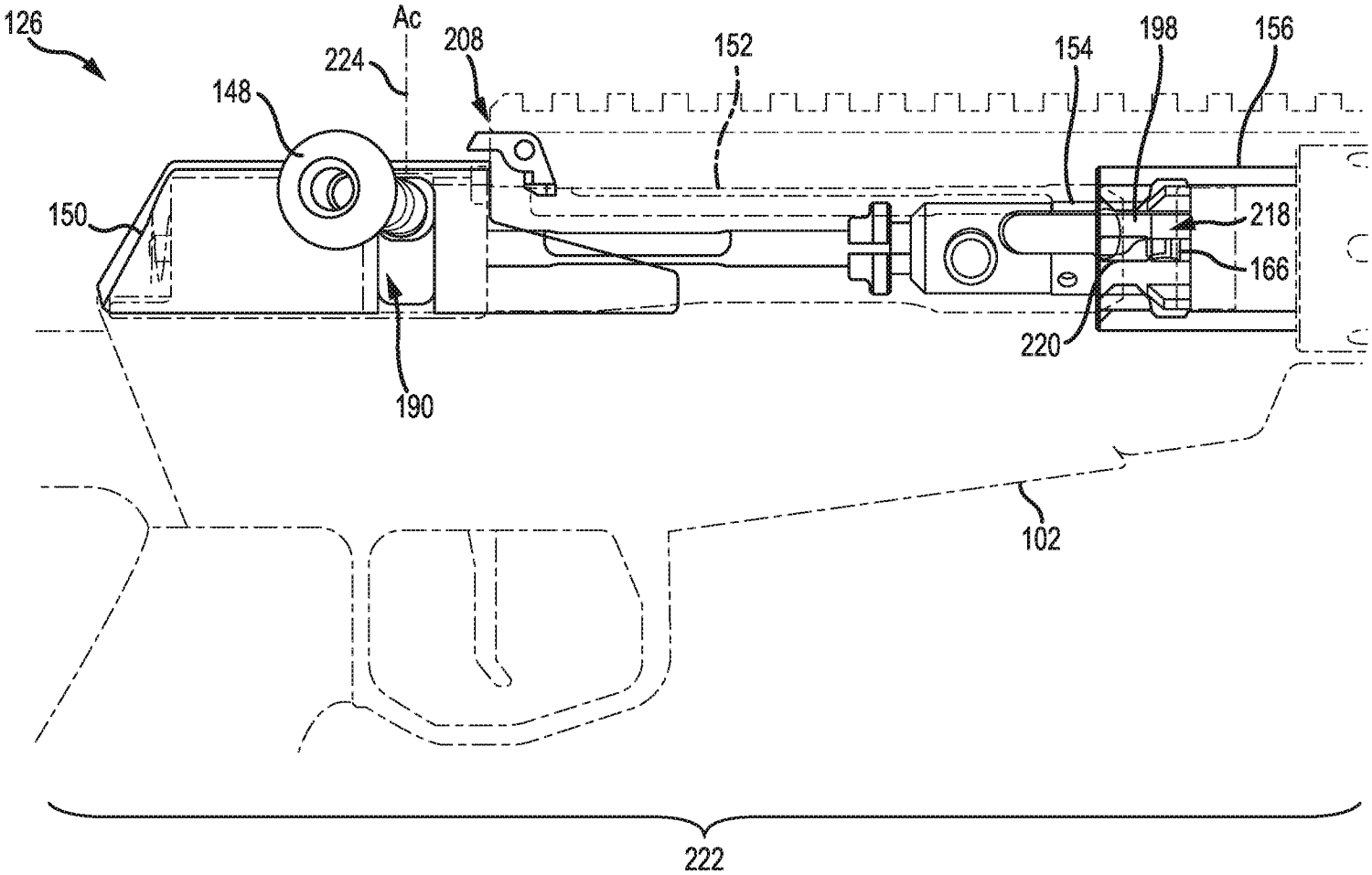
FIG. 3C is a side view of the bolt assembly in a pivot position.

FIG. 3C is a side view of the bolt assembly 126 in the pivot position 222. In the pivot position 222, the handle 148 is still positioned in the second rotated position such that the bolt lugs 166 are axially offset with the chamber lugs 198 and the shroud 150 is in the axially forward position as described above. Additionally, the handle 148 is pivoted about a pivot axis 224 in a backwards and clockwise direction within the circumferential opening 190 while in the second rotated position. The pivot axis 224 is disposed at an angle that is substantially skew relative to the longitudinal axis 158. In the example, the handle 148 is configured to pivot in a range of 0 degrees to 90 degrees. As the handle 148 pivots around the pivot axis 224, an extension portion 236 of the cam 182 is configured to engage with a fulcrum 234 on the circumferential groove 232 (both shown in FIGS. 4A-C) of the shroud 150 so as to substantially simultaneously axially move the bolt body 152 and the bolt 154 in a backward direction and in relation to the shroud 150 and the firing chamber 156 to begin the initial extraction pull. The cam 182 engaging with the fulcrum 234 will be discussed further below in reference to FIGS. 4A-C. By axially moving the bolt body 152 backwards, via pivoting the handle 148, the bolt 154 is also axially moved along the longitudinal axis 158 at a predetermined distance such that at least a portion of the bolt lugs 166 are received within the chamber recesses 220. The shroud 150, however, maintains its forward position to provide leverage to the pivoting handle 148.

In the pivot position 222, the spent ammunition cartridge still remains with the firing chamber 156. However, the bolt 154 has continued to be further disengaged with the firing chamber 156. To remove and eject the spent cartridge from the pivot position 222, the handle 148 is moved to an eject position 226 (shown in FIG. 3D) after pivoting the handle 148 about the pivot axis 224.

Figure 3D:
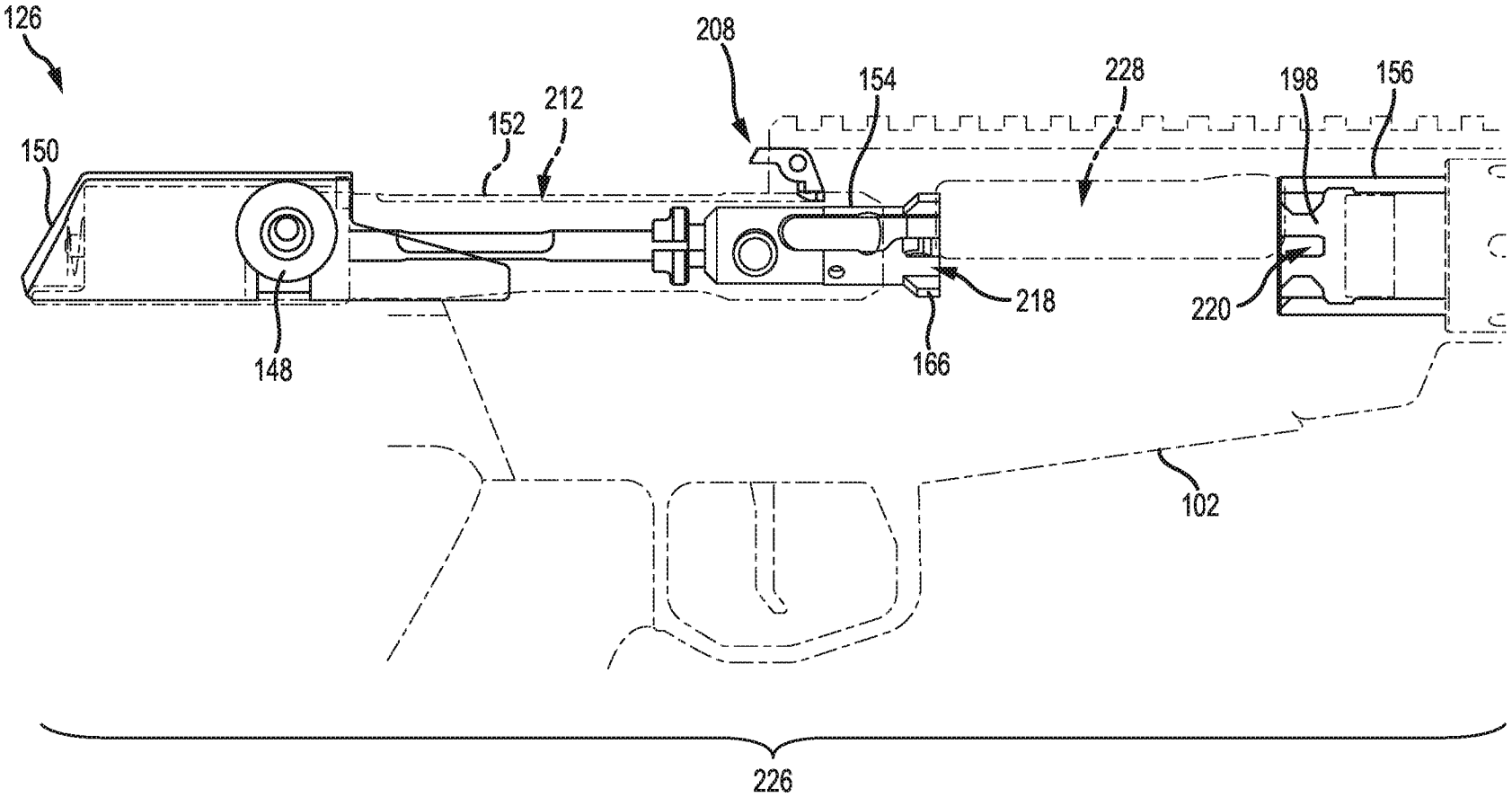
FIG. 3D is a side view of the bolt assembly in an eject position.

FIG. 3D is a side view of the bolt assembly 126 in the eject position 226. In the eject position 226, the handle 148 is still positioned in the second rotated position such that the bolt lugs 166 are axially offset with the chamber lugs 198 and the handle 148 has pivoted back about the pivot axis 224. Additionally, the bolt assembly 126 is positioned in an axially backward position, in which the bolt 154, the bolt body 152, the shroud 150, and the handle 148 are positioned axially backward within the receiver 102 and at a predetermined distance from the firing chamber 156. As the handle 148 is moved to the backward position (e.g., an extraction pull), the bolt lugs 166 fully disengage with the firing chamber 156 by sliding through the chamber recesses 220 and are positioned axially behind the chamber lugs 198. The bolt 154 axial movement also facilitates ejecting the spent ammunition cartridge from the receiver 102 through an opening 228 defined therein. Additionally, the shroud 150 slidably moves along the longitudinal axis 158 in relation to the receiver 102 and the bolt release assembly 208 slides axially within the axial section of the bolt body groove 212.

Once the bolt assembly 126 ejects the spent ammunition cartridge and is in the eject position 226, the firearm 100 and bolt assembly 126 may be cycled through to the firing position 200 to reload ammunition into the firing chamber 156. To reload the firearm 100, the bolt assembly 126 is moved from the eject position 226 back to the firing position 200. For example, the handle 148 is moved axially along the longitudinal axis 158 while maintaining the second rotated position in a direction towards the front 118. This axial movement from the handle 148 axially moves the shroud 150, the bolt body 152, and the bolt 154 from the backward position to the forward position such that the bolt 154 is at least partially inserted into the firing chamber opening 196. By maintaining the handle 148 in the second rotated position the bolt lugs 166 are axially aligned with the chamber recesses 220 such that the bolt 154 may move into the firing position 200 with the bolt lugs 166 axially forward of the chamber lugs 198. The bolt release assembly 208 also slides axially within the axial section of the bolt body groove 212. Additionally, this axial forward movement of the bolt 154 facilitates inserting a new ammunition round into the firing chamber 156. In some examples, the new ammunition round is provided from a magazine coupled to the magazine well 114. In other examples, the new ammunition round is manually feed into the receiver opening 228 before moving the bolt 126 back into the firing position 200.

Once the handle 148, the bolt body 152, and the bolt 154 are moved in the axially forward position, the handle 148 is rotated in a downward or clockwise direction from the second rotated position to the first rotated position to engage the bolt 154 with the firing chamber in preparation for discharging the firearm 100. Moving the handle 148 back into the first rotated position axially aligns and engages the bolt lugs 166 and the chamber lugs 198 to restrict backwards axial movement of the bolt 154. The bolt release assembly 208 also slides circumferentially within the circumferential section of the bolt body groove 212. This cycling of the bolt assembly 126 between the firing position 200, the rotate position 216, the pivot position 222, and the eject position as illustrated in FIGS. 3A-D may occur at will to discharge ammunition from the firearm 100 and to eject the spent ammunition cartridges therefrom. Additionally, while the figures herein and the description in regards to operating the firearm 100 describe the handle 148 as being on the right side of the firearm 100 when looking from the back 120 to the front 118, it is appreciated that the bolt assembly 126 may also be positioned on the left side of the firearm 100.

Figure 4A:
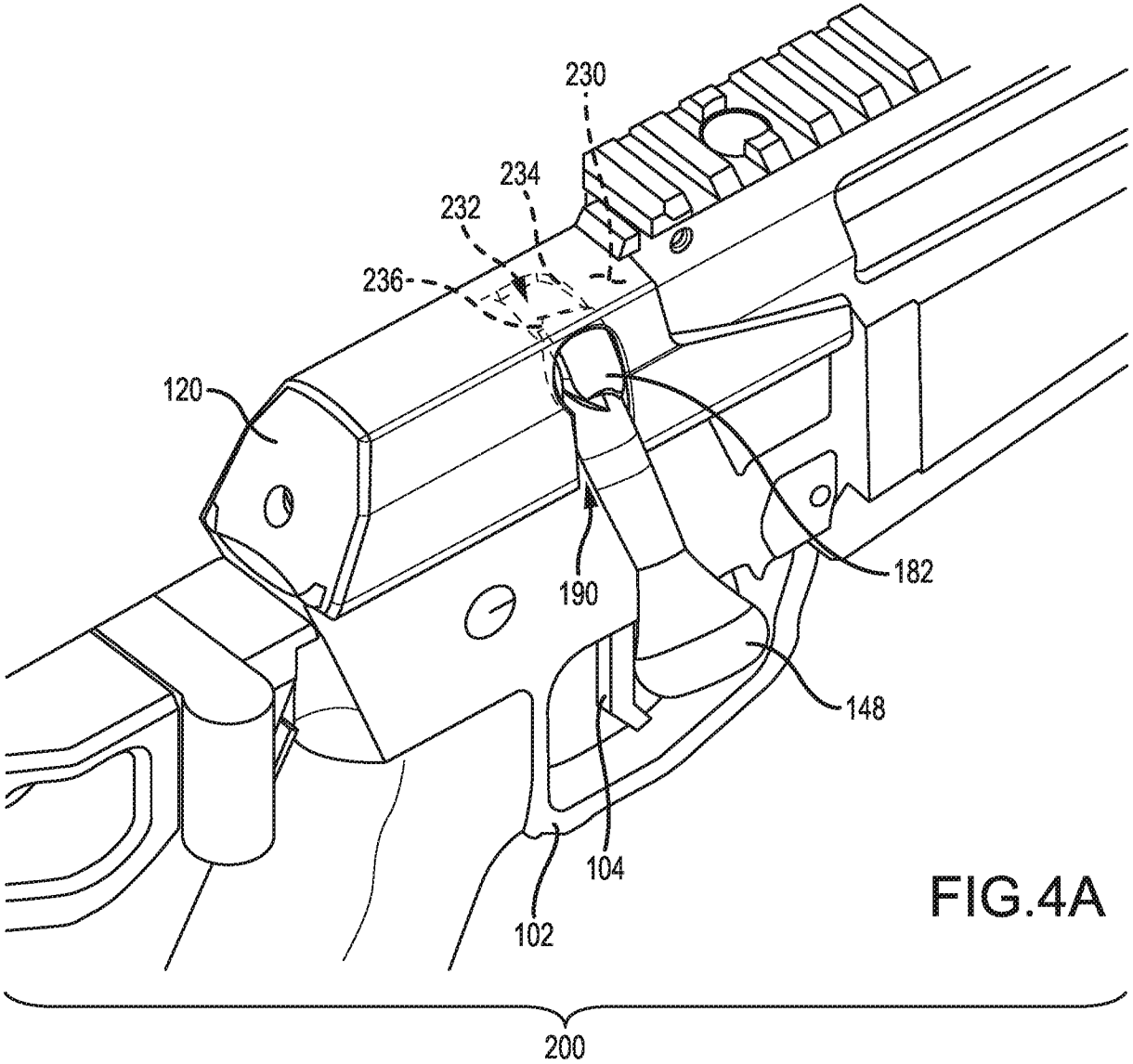
FIG. 4A is a perspective view of an example handle in the firing position.

FIG. 4A is a perspective view of the handle 148 in the firing position 200. As described above in reference to FIG. 3A, the bolt assembly 126 is positioned in the axially forward position, where the shroud 150 and the handle 148 are positioned axially forward within the receiver 102. Additionally, the handle 148 is rotated in the first rotated position within the shroud 150 and in relation to the receiver 102. The handle 148 extends substantially downward and adjacent the receiver 102 within the circumferential opening 190 (shown in FIG. 6A). The shroud 150 includes the inner circumferential surface 230 that includes the circumferential groove 232 defined therein and extending from the end of the circumferential opening 190 at the top 122 of the firearm 100. The circumferential groove 232 includes a fulcrum location 234 positioned on the forward sidewall thereof. At least a portion of the cam 182 of the handle 148 is received within the circumferential groove 232 and is slidable therein as the handle is moved to the second rotated position (shown in FIG. 4B). For example, the cam 182 includes an extension portion 236 extending therefrom, and the extension portion 236 is received within the circumferential groove 232 when the handle 148 is in the first rotated position.

In the firing position 200, the handle 148 is in the first rotated position such that the bolt 154 is engaged with the firing chamber 156 to restrict axial movement backwards as described further above. The firing position 200 also enables the trigger mechanism 104 to be pulled such that the ammunition round is discharged from the firing chamber 156. To remove and eject the spent cartridge from the receiver 102, the handle 148 is first moved from the firing position 200 to the rotate position 216 (shown in FIG. 4B).

Figure 4B:
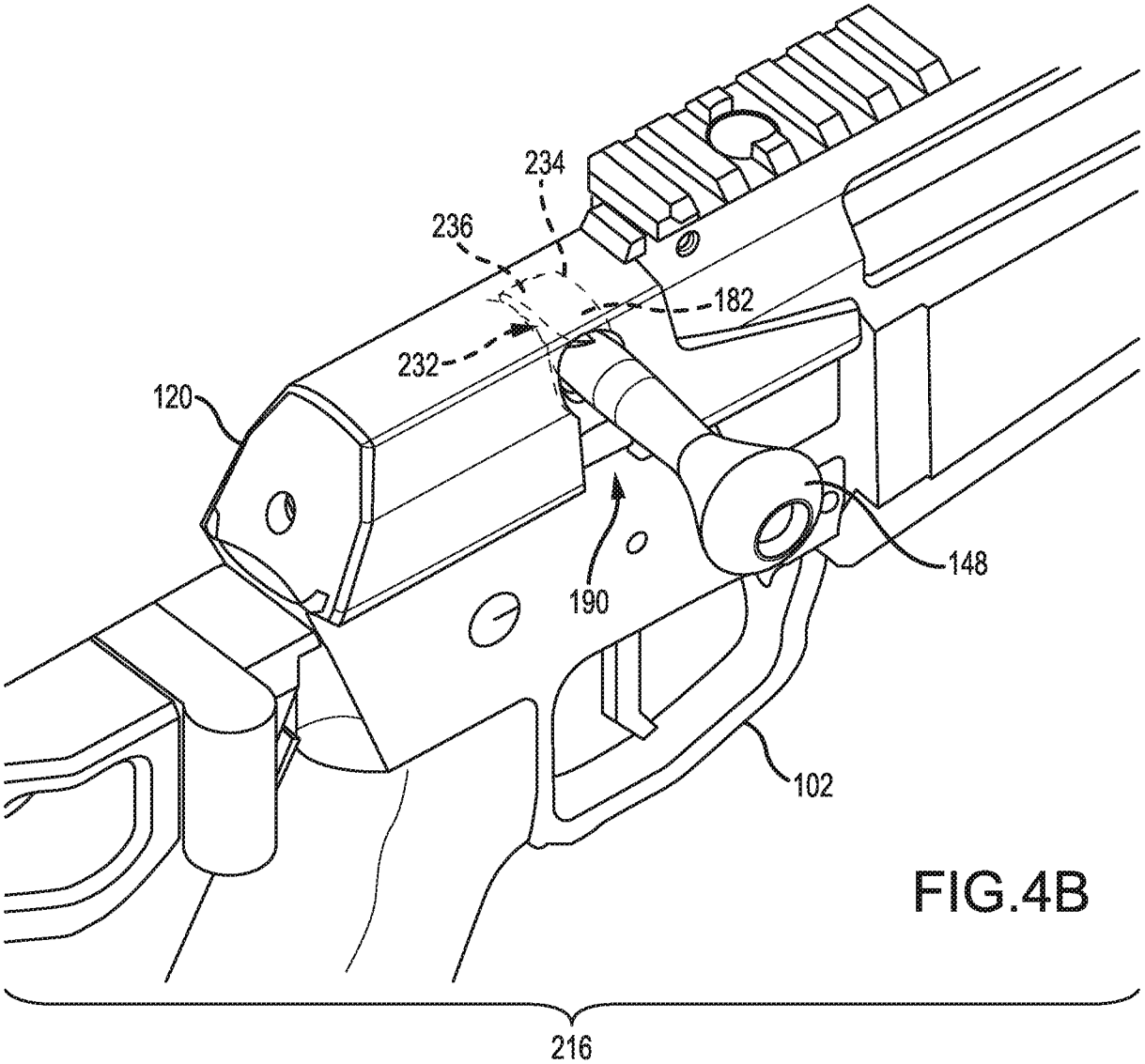
FIG. 4B is a perspective view of the handle in the rotate position.

FIG. 4B is a perspective view of the handle 148 in the rotate position 216. As described above in reference to FIG. 3B, the bolt assembly 126 is still positioned in the axially forward position such that the shroud 150 and the handle 148 are positioned axially forward within the receiver 102. Additionally, the handle 148 is rotated in the second rotated position within the shroud 150 and in relation to the receiver 102. From the first rotated position (FIG. 4A) the handle 148 is rotated about the longitudinal axis 158 in an upwards and counter-clockwise direction to the second rotated position towards the top 122 of the firearm 100. The second rotated position is defined by the handle 148 extending substantially orthogonal to the receiver 102 (as shown in FIG. 6B). As the handle 148 is rotated from the first rotated position to the second rotated position, the cam 182 slidably engages with the circumferential groove 232 such that the cam 182 is received therein. When the handle 148 is rotated from the first rotated position to the second rotated position, the bolt lugs 166 are axially offset with the chamber lugs 198 such that the pivot position 222 (shown in FIG. 4C) of the handle 148 may begin the axial movement of the bolt 154 in relation to the firing chamber 156.

Figure 4C:
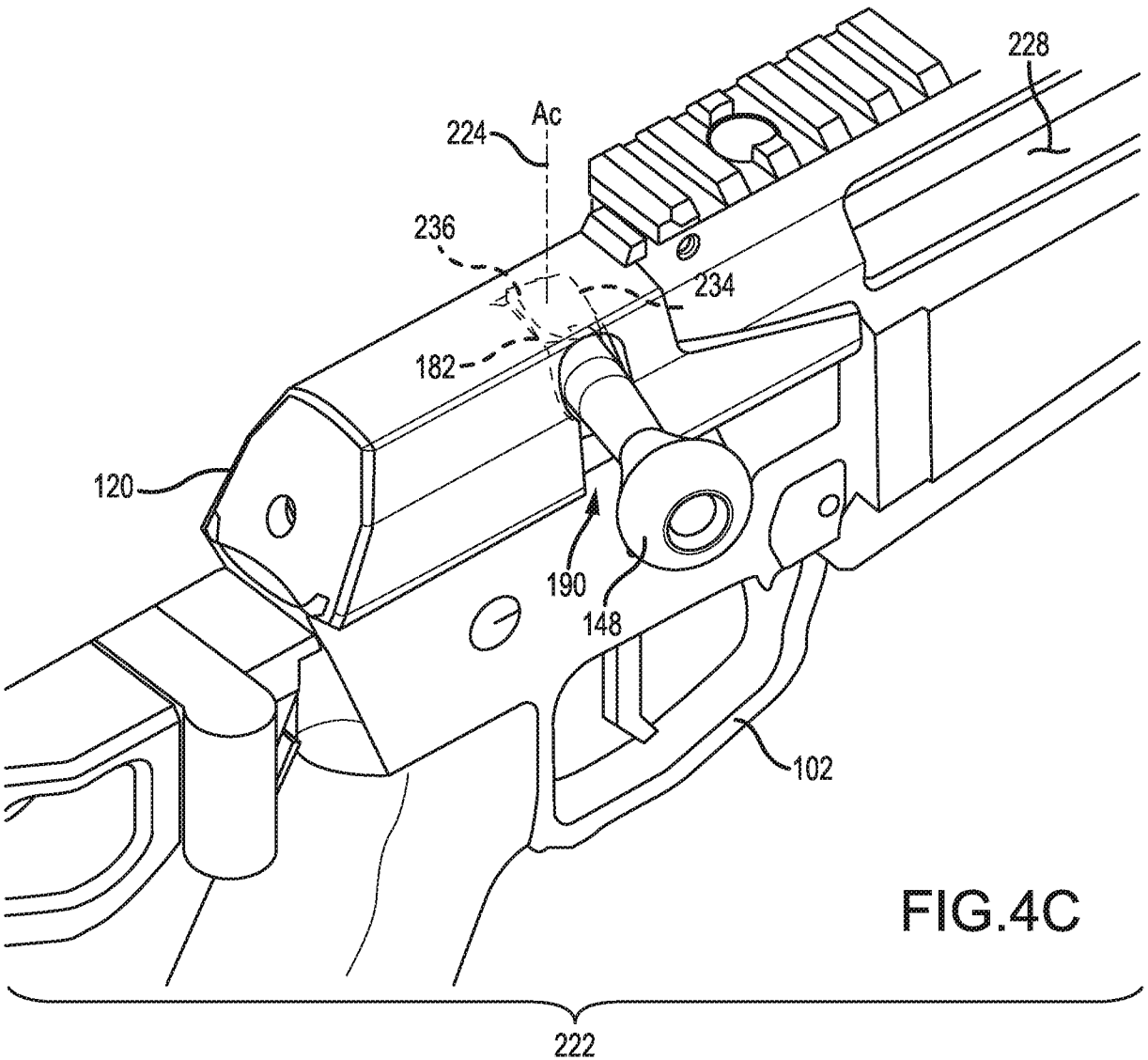
FIG. 4C is a perspective view of the handle in the pivot position.

FIG. 4C is a perspective view of the handle 148 in the pivot position 222. As described above in reference to FIG. 3C, the handle 148 is positioned in the second rotated position and the shroud 150 is in the axially forward position in relation to the receiver 102. Additionally, the handle 148 is pivoted about the pivot axis 224 in a backwards and clockwise direction within the circumferential opening 190 while in the second rotated position. As the handle 148 pivots around the pivot axis 224, the cam 182 also pivots within the circumferential groove 232 so that the extension portion 236 is configured to engage with the fulcrum 234 and uses the handle 148 as a lever to move the bolt 154. This engagement substantially simultaneously axially moves the bolt body 152 and the bolt 154 in a backward direction and in relation to the shroud 150 and the firing chamber 156 initiating extraction position. For example, the shroud 150 is maintained in the forward position, so that as the handle 148 pivots backwards, the extension portion 236 engages with the fulcrum 234 for leverage to initiate axial movement of the bolt body 152 and the bolt 154 along the longitudinal axis 158.

By axially moving the bolt body 152 backwards, via pivoting the handle 148, the bolt 154 begins axial disengagement with the firing chamber 156. From the pivot position 222, the handle 148 is moved to the eject position 226 (shown in FIG. 3D) such that the bolt assembly 126 is positioned in the axially backward position. As the handle 148 is moved to the backward position, the bolt lugs 166 fully disengage with the firing chamber 156, sliding within the chamber recesses 220, such that the bolt lugs are positioned axially behind the chamber lugs 198 and the spent ammunition cartridge is ejected through the receiver opening 228. Once the bolt assembly 126 ejects the spent ammunition cartridge and is in the eject position 226, the firearm 100 and bolt assembly 126, via the handle 148, may be cycled through to the firing position 200 to reload ammunition into the firing chamber 156 as described above.

Figure 5A:
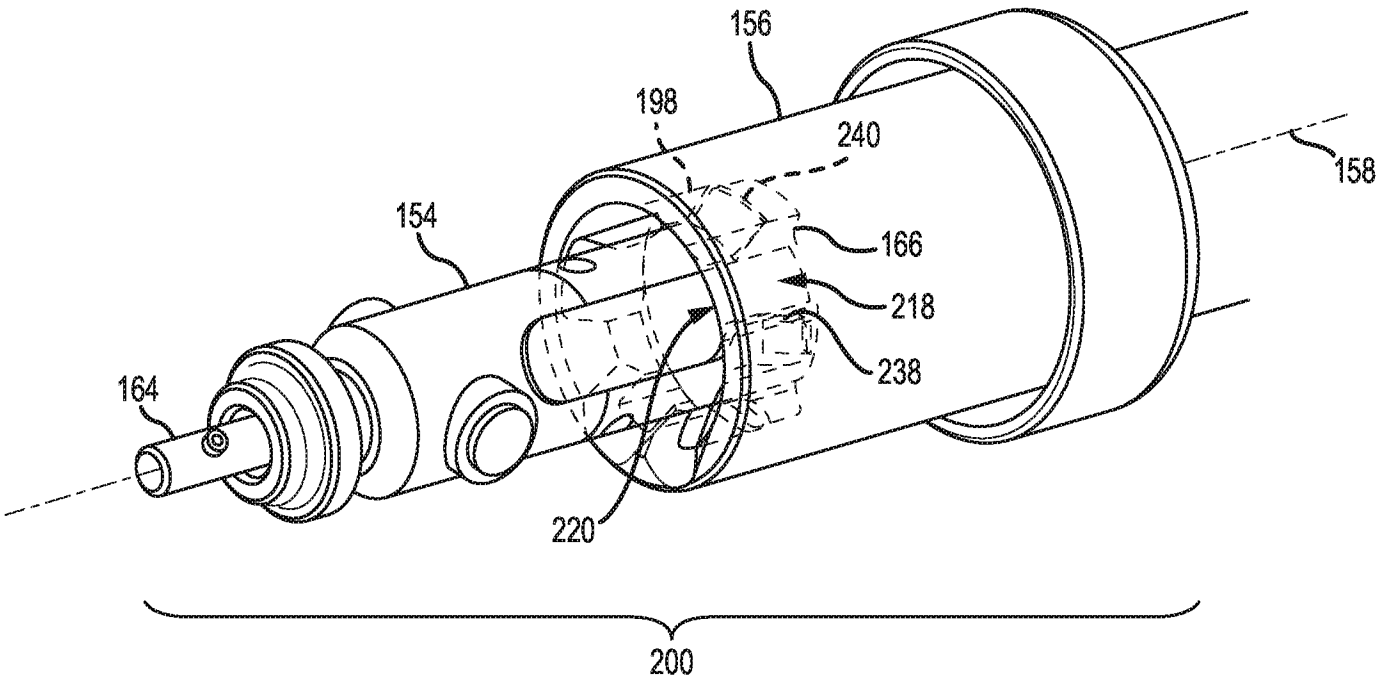
FIG. 5A is a perspective view of an example bolt in the firing position.

FIG. 5A is a perspective view of the bolt 154 in the firing position 200. As described above in reference to FIGS. 3A and 4A, the bolt assembly 126 is positioned in the axially forward position, with the bolt 154 positioned axially forward within the receiver 102 and in relation to the firing chamber 156. Additionally, the bolt 154 is rotated in the first rotated position within the receiver 102 and in relation to the firing chamber 156. In the firing position 200 the bolt lugs 166 are axially aligned with and engaged with the chamber lugs 198. In the example, the bolt 154 has a plurality of lugs 166 extending radially outward from the forward end 160. For example, the bolt 154 has four lugs 166; however, in alternative examples the bolt 154 may have any other number of lugs 166. Each lug 166 has a radial thickness and a circumferential width at least partially defining a size thereof. Additionally, each lug 166 has an engagement surface 238 that is the backward face of the lug 166 and is configured to engage with the corresponding chamber lug 198. The plurality of bolt recesses 218 are defined between each lug 166 and each recess 218 has a circumferential width. In some examples, the lugs 166 vary in size and spacing circumferentially around the bolt 154. In other examples, the lugs 166 may be equally sized and spaced circumferentially around the bolt 154.

In the example, the firing chamber 156 also has a plurality of corresponding lugs 198 extending radially inward from the back end 194. Each lug 198 has a radial thickness and a circumferential width at least partially defining a size thereof. Additionally, each lug 198 has an engagement surface 240 that is the forward face of the lug 198 and is configured to engage with the corresponding bolt lug 166. The plurality of chamber recesses 220 are defined between each lug 198 and each recess 220 has a circumferential width. In some examples, the lugs 198 vary in size and spacing circumferentially around the firing chamber 156. In other examples, the lugs 198 may be equally sized and spaced circumferentially around the firing chamber 156. In the firing position 200 one or more of the bolt engagement surfaces 238 are aligned with and engaged with one or more of the chamber engagement surface 240 so as to restrict axial movement of the bolt 154 backwards.

Figure 5B:
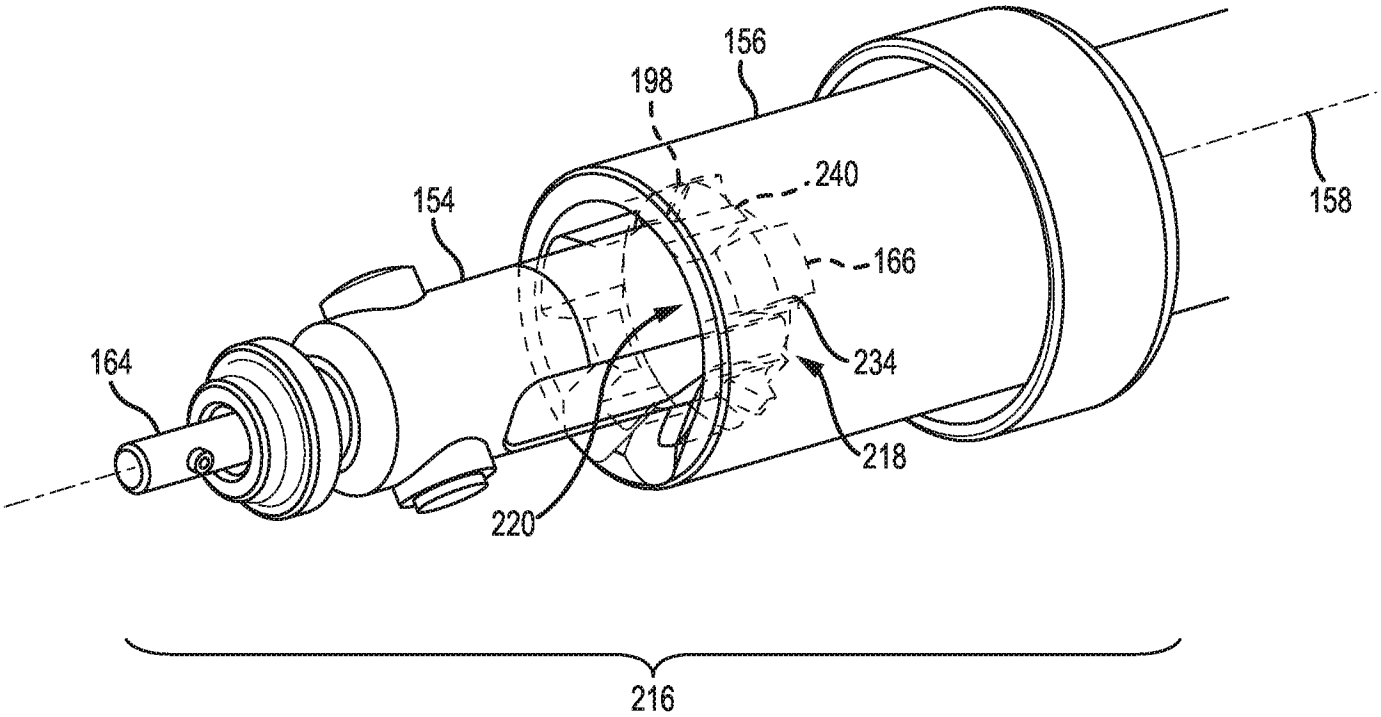
FIG. 5B is a perspective view of the bolt in the rotate position.

FIG. 5B is a perspective view of the bolt 154 in the rotate position 216. As described above in reference to FIGS. 3B and 4B, the bolt assembly 126 is positioned in the axially forward position, with the bolt 154 positioned axially forward within the receiver 102 and in relation to the firing chamber 156. Additionally, the bolt 154 is rotated in the second rotated position with the receiver 102 and in relation to the firing chamber 156. In the rotate position 216 the bolt lugs 166 are axially offset from the chamber lugs 198. For example, the bolt 124 is rotated about the longitudinal axis 158 such that each bolt lug 166 is axially aligned with the chamber recesses 220 and each chamber lug 198 is axially aligned with the bolt recesses 218. As such, when the bolt 154 is axially moved backward along the longitudinal axis 158, (e.g., during the pivot position 222 and the eject position 226) the bolt 154 may be removed from the firing chamber 156.

At least some known bolt assemblies include cammed surfaces on the handle and the lugs such that as the bolt is rotated (e.g., between a first rotated position and a second rotated positon, such as the positions shown above), the cammed surfaces facilitate disengaging the lugs from the firing chamber to begin to initiate extraction pull. These cammed surface facilitate a single rotating motion of the handle to axially disengage the bolt lugs, however, these cammed surfaces may increase undesirable timing issues and also decrease the strength of the lugs as described above. In contrast, the bolt assembly 126 described herein includes two discrete operations. The handle 148 is first rotated about the longitudinal axis 158 to axially offset the bolt lugs 166 from the firing chamber 156 and then an extra step where the handle 148 pivots about the pivot axis 224 to facilitate axially disengaging the bolt lugs 166 from the firing chamber 156 and initiate extraction pull. By rotating and then pivoting the handle 148 to initiate extraction pull, this reduces timing issues and enables the engagement surfaces 238 and 240 to be pure bearing surfaces and increases the strength of the lugs 166 and 198 respectively. By increasing the strength of the bolt 154 and the firing chamber 156 engagements, the overall strength and efficiency of the bolt assembly 126 is also increased.

Figure 6A:
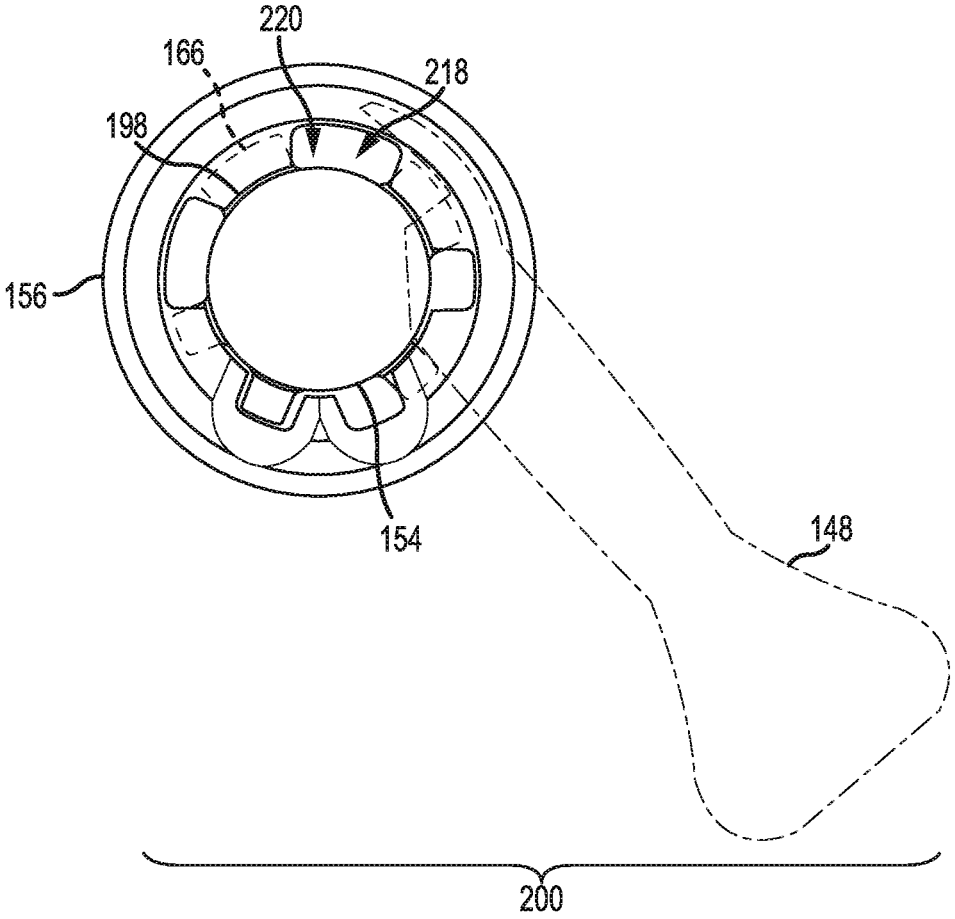
FIG. 6A is a cross-sectional view of the bolt in the firing position.
Figure 6B:
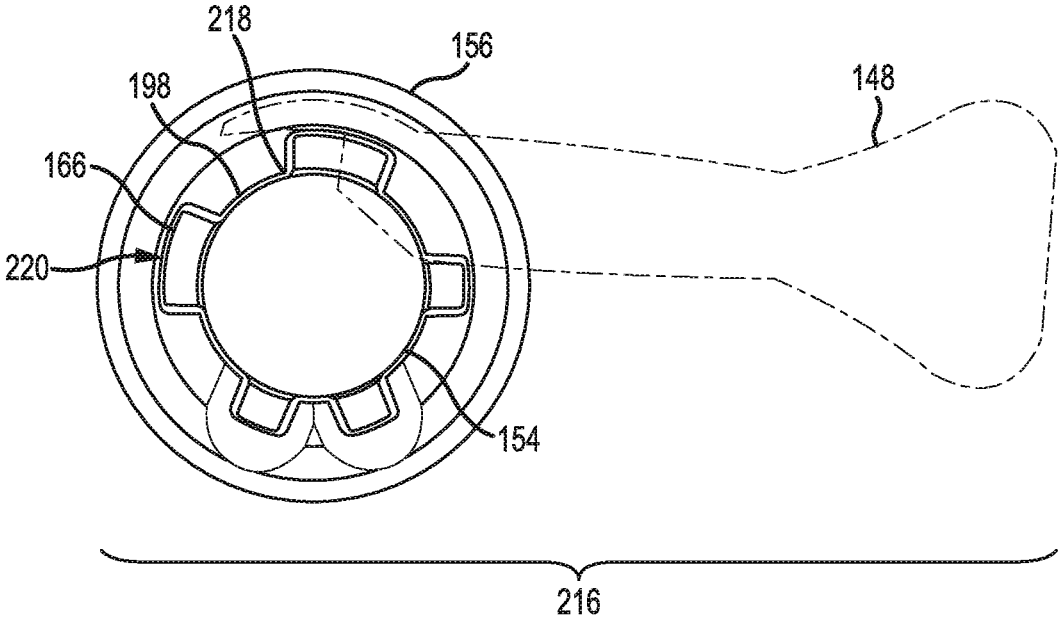
FIG. 6B is a cross-sectional view of the bolt in the rotate position.

FIG. 6A is a cross-sectional view of the bolt 154 in the firing position 200. As described above in reference to FIG. 5A, the bolt 154 is rotated in the first rotated position within the receiver 102 and in relation to the firing chamber 156. In the firing position 200 at least one of the bolt lugs 166 is axially aligned with and engaged with the chamber lugs 198. Additionally, at least one of the bolt recesses 218 is axially aligned with the chamber recesses 220. The handle 148 is also illustrated in its first rotated position and extending downward adjacent to the receiver 102.

FIG. 6B is a cross-sectional view of the bolt 154 in the rotate position 216. As described above in reference to FIG. 5B, the bolt 154 is rotated in the second rotated position within the receiver 102 and in relation to the firing chamber 156. In the rotate position 216 the bolt lugs 166 are axially offset with the chamber lugs 198. The bolt lugs 166 are axially aligned with the chamber recesses 220 and the chamber lugs 198 are axially aligned with the bolt recesses 218. As such, the bolt 154 is axially slidable in a backwards direction in relation to the firing chamber 156. The handle 148 is also illustrated in its second rotated position.

Figure 7:
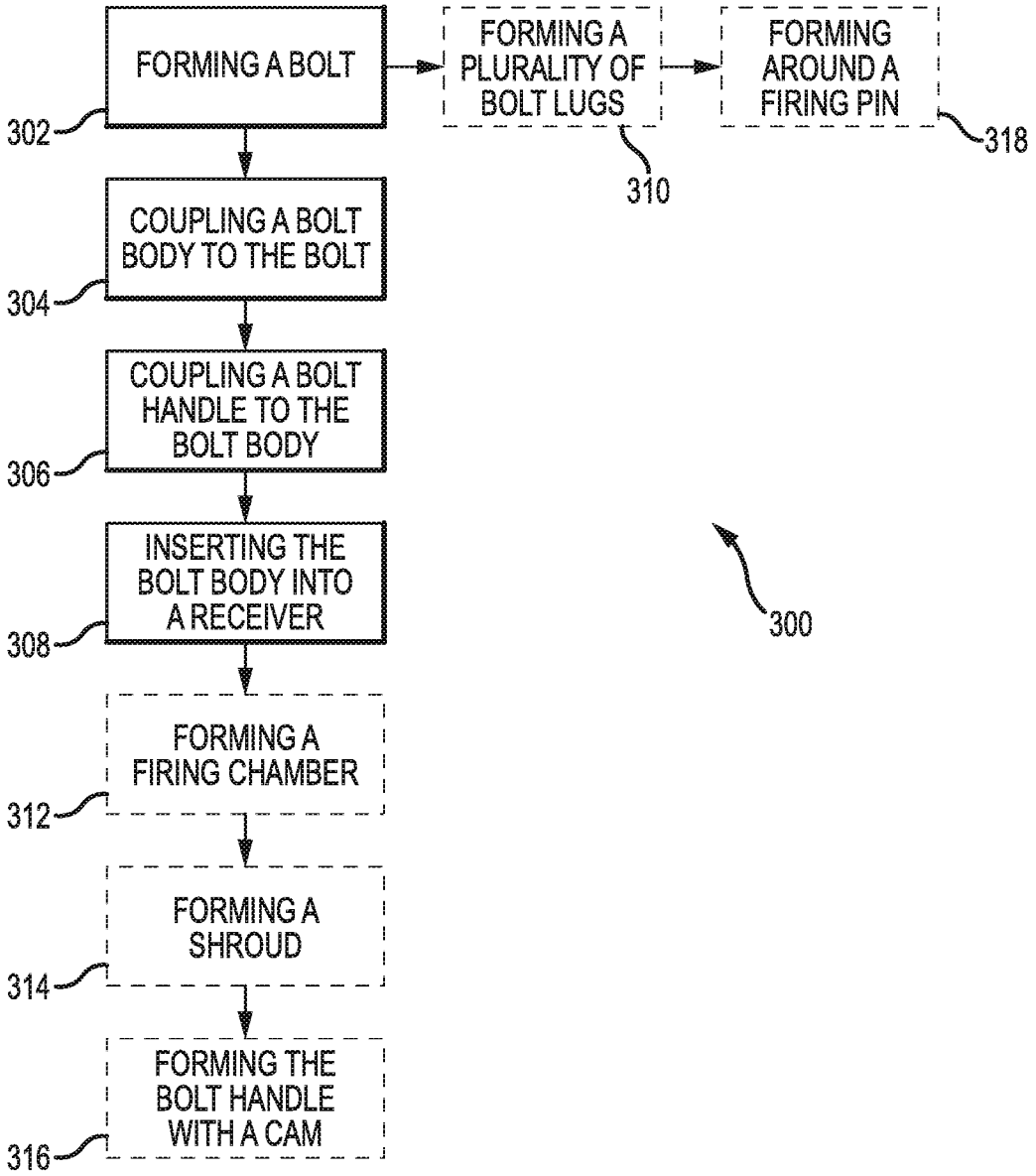
FIG. 7 is a flowchart illustrating a method of manufacturing the bolt assembly.

FIG. 7 is a flowchart illustrating a method 300 of manufacturing a firearm including a receiver and a bolt assembly. The method 300 includes forming 302 a bolt including a body axis. The bolt is coupled 304 to a bolt body such that the bolt body is configured to discretely rotate about the body axis within the receiver and axially slide along the body axis. A bolt handle is coupled 306 to the bolt body and the bolt body is inserted 308 into the receiver such that the bolt handle is configured to discretely rotate with the bolt body about the body axis and move with the bolt body along the body axis.

The method 300 may further include forming 310 the bolt with a plurality of bolt lugs extending radially therefrom. A firing chamber may be formed 312 in the firearm such that the firing chamber includes a plurality of firing chamber lugs extending radially therefrom and the plurality of bolt lugs are configured to rotatably engage with the plurality of firing chamber lugs. A shroud may also be formed 314 such that the shroud is configured to slidably engage with the receiver and axial sliding of the bolt body within the receiver moves the shroud relative to the receiver. The bolt handle may be formed 316 with a cam such that the cam is configured to couple the bolt handle to the bolt body and the bolt may be formed 318 around a firing pin.

Figure 8:
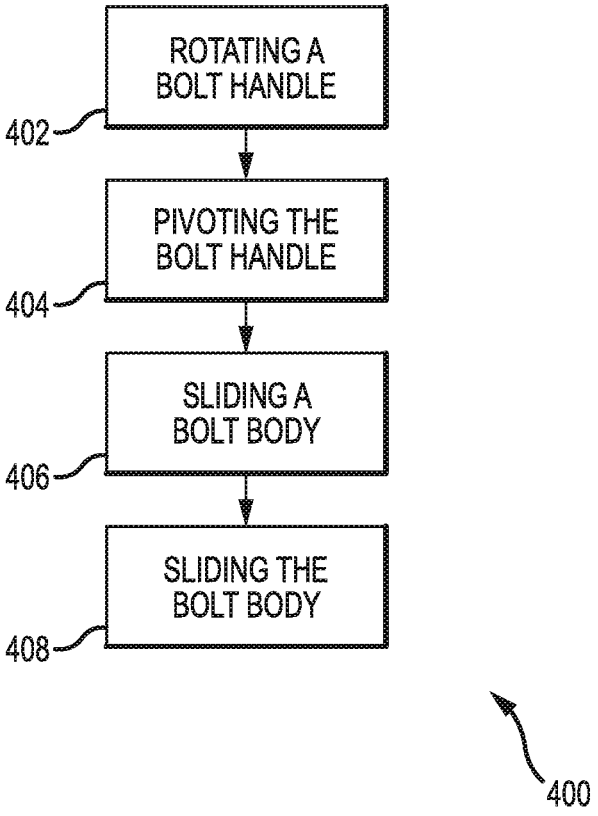
FIG. 8 is a flowchart illustrating a method of clearing a cartridge from the firearm.

FIG. 8 is a flowchart illustrating a method 400 of clearing a cartridge from a firearm, such as the firearm 100 shown in FIGS. 1 and 2, including a bolt body, such as the bolt body 152, rotatably and slidably disposed in a receiver, such as the receiver 102. The method 400 includes rotating 402, about a body axis, such as the longitudinal axis 158, defined by the bolt body, a bolt handle, such as the handle 148, from a first rotated position to a second rotated position, so as to rotate the bolt body about the body axis. For example, rotating the handle 148 from the firing position 200 (shown in FIG. 3A) to the rotate position 216 (shown in FIG. 3B). After disposing the bolt handle in the second rotated positon, the bolt handle is pivoted 404 about a pivot axis, such as pivot axis 224, disposed at an angle to the body axis. Substantially simultaneously with pivoting the bolt handle, the bolt body is slid 406 from a forward position within the receiver towards a rearward position with the receiver. For example, pivoting the handle 148 from the rotate position 216 (shown in FIG. 3B) to the pivot position 222 (shown in FIG. 3C). The bolt body is then slid 408 into the rearward position so as to eject the cartridge from the receiver. For example, moving the handle 148 from the pivot position 222 (shown in FIG. 3C) to the eject position 226 (shown in FIG. 3D). The method 400 may further include the pivoting operation 404 to cause a cam disposed on the bolt handle, such as the cam 182 to contact a fulcrum disposed on a shroud, such as the fulcrum 234 on the shroud 150, so as to slide the bolt body towards the rearward position.

The various embodiments described above are provided by way of illustration only and should not be construed to limit the claims attached hereto. Those skilled in the art will readily recognize various modifications and changes that may be made without following the example embodiments and application illustrated and described herein, and without departing from the true spirit and scope of the following claims.

I claim:

1. A rifle comprising:

a receiver;

a bolt body at least partially disposed in the receiver and comprising a body axis, wherein the bolt body is discretely (1) rotatable about the body axis within the receiver between a first rotated position and a second rotated position and (2) axially slidable along the body axis; and a bolt handle coupled to the bolt body so as to discretely (1) rotate with the bolt body about the body axis between a first and a second rotated position; (2) move with the bolt body along the body axis; (3) pivot in relation to the bolt body about an axis disposed at an angle to the body axis when the bolt handle is in the second rotated position; and (4) not pivot in relation to the bolt body when the bolt handle is in the first rotated position.

2. The rifle of claim 1, further comprising a cam coupling the bolt handle to the bolt body.

3. The rifle of claim 2, further comprising a fulcrum fixed relative to the receiver, wherein the cam is configured to engage the fulcrum prior to the bolt body axially sliding along the body axis.

4. The rifle of claim 3, wherein engagement between the cam and the fulcrum pivots the bolt handle about an axis substantially skew to the body axis.

5. The rifle of claim 3, wherein engagement between the cam and the fulcrum slides the bolt body along the body axis.

6. The rifle of claim 1, further comprising a shroud slidably engaged with the receiver, wherein axial sliding of the bolt body moves the shroud relative to the receiver.

7. The rifle of claim 4, where the bolt handle is configured to pivot in a range of 0 degrees to 90 degrees.

8. A method of manufacturing a firearm including a receiver and a bolt assembly, the method comprising:

forming a bolt including a body axis;

coupling a bolt body to the bolt, wherein the bolt body is configured to discretely (1) rotate about the body axis within the receiver and (2) axially slide along the body axis;

coupling a bolt handle to the bolt body; and inserting the bolt body into the receiver such that the bolt handle is configured to discretely (1) rotate with the bolt body about the body axis between a first and a second rotated position; (2) move with the bolt body along the body axis; (3) pivot in relation to the bolt body about an axis disposed at an angle to the body axis when the bolt handle is in the second rotated position; and (4) not pivot in relation to the bolt body when the bolt handle is in the first rotated position.

9. The method of claim 8 further comprising:

forming the bolt with a plurality of bolt lugs extending radially therefrom; and forming a firing chamber in the firearm, wherein the firing chamber comprising a plurality of firing chamber lugs extending radially therefrom, wherein the plurality of bolt lugs are configured to rotatably engage with the plurality of firing chamber lugs.

10. The method of claim 8 further comprising forming a shroud, wherein the shroud is configured to slidably engage with the receiver and wherein axial sliding of the bolt body within the receiver moves the shroud relative to the receiver.

11. The method of claim 8 further comprising forming the bolt handle with a cam, wherein the cam is configured to couple the bolt handle to the bolt body.

12. The method of claim 8 further comprising forming the bolt around a firing pin.

13. An apparatus comprising:

a firing chamber defining an axis and comprising a plurality of firing chamber lugs;

a bolt axially aligned with the firing chamber and comprising a plurality of bolt lugs, wherein the plurality of bolt lugs are disposed radially asymmetrically about the axis, and wherein the plurality of bolt lugs are each rotatably engageable with one of the plurality of firing chamber lugs;

a bolt body engaged with the bolt, wherein rotation of the bolt body about a body axis rotates the bolt; and a bolt handle engaged with the bolt body and configured to: (1) rotate with the bolt body about the body axis between a first and a second rotated position; (2) pivot in relation to the bolt body about an axis disposed at an angle to the body axis when the bolt handle is in the second rotated position; and (3) not pivot in relation to the bolt body when the bolt handle is in the first rotated position.

14. The apparatus of claim 13, wherein the bolt handle is pivotably engaged with the bolt body.

15. The apparatus of claim 13, wherein when the bolt handle is in a first rotated position, the plurality of bolt lugs are engaged with the plurality of firing chamber lugs.

16. The apparatus of claim 15, wherein when the bolt handle is in a second rotated position, the plurality of bolt lugs are disengaged and offset from the plurality of firing chamber lugs.

17. The apparatus of claim 16, wherein when the bolt handle is in a first pivoted position, the plurality of bolt lugs are axially disposed a predetermined distance from the plurality of firing chamber lugs.

18. The apparatus of claim 13, further comprising a cam for pivotably engaging the bolt handle with the bolt body.

19. Apparatus of claim 18, further comprising a firing pin extending axially from the bolt.

20. The apparatus of claim 19, wherein the cam comprises a plurality of tines extending therefrom, wherein the tines are disposed on opposite sides of a firing pin shaft.

* * * * *